US008634752B2

(12) United States Patent
Yamamoto et al.

(10) Patent No.: US 8,634,752 B2
(45) Date of Patent: Jan. 21, 2014

(54) FIXING DEVICE THAT FIXES A TONER IMAGE ON A RECORDING MATERIAL

(75) Inventors: Koji Yamamoto, Toyokawa (JP); Hiroshi Funabiki, Uenohara (JP); Masanori Murakami, Hachioji (JP); Jinju Okuno, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 622 days.

(21) Appl. No.: 12/910,410

(22) Filed: Oct. 22, 2010

(65) Prior Publication Data

US 2011/0097121 A1 Apr. 28, 2011

(30) Foreign Application Priority Data

Oct. 27, 2009 (JP) ..... 2009-246284

(51) Int. Cl.
*G03G 15/20* (2006.01)

(52) U.S. Cl.
USPC ..... 399/323; 399/398

(58) Field of Classification Search
USPC ..... 399/323, 398
See application file for complete search history.

(56) References Cited

U.S. PATENT DOCUMENTS

| | | | | |
|---|---|---|---|---|
| 4,168,830 | A * | 9/1979 | Hori et al. | 399/398 |
| 8,385,798 | B2 * | 2/2013 | Funabiki et al. | 399/323 |
| 8,433,229 | B2 * | 4/2013 | Murakami et al. | 399/323 |
| 2007/0147912 | A1 * | 6/2007 | Fujii | 399/323 |
| 2007/0206981 | A1 | 9/2007 | Amico | |

FOREIGN PATENT DOCUMENTS

| | | |
|---|---|---|
| JP | 60-247672 | 12/1985 |
| JP | 60-256180 | 12/1985 |
| JP | 61-62087 | 3/1986 |
| JP | 2000-003106 | 1/2000 |
| JP | 2004-212954 | 7/2004 |
| JP | 2007-86132 | 4/2007 |
| JP | 2009-205129 | 9/2009 |
| JP | 2009-205131 | 9/2009 |

OTHER PUBLICATIONS

European Search Report dated Feb. 1, 2011 corresponding to EP 10 18 7852.
Office Action in corresponding Japanese Application No. 2009-246284, dated May 13, 2013.

* cited by examiner

*Primary Examiner* — David Gray
*Assistant Examiner* — Laura Roth
(74) *Attorney, Agent, or Firm* — Finnegan, Henderson, Farabow, Garrett & Dunner, L.L.P.

(57) ABSTRACT

A fixing device fixing a toner image on a recording material includes a first blowing section that blows air against a leading edge of the recording material that has passed through a nip portion formed by a heated fixing member and a pressing member kept in pressure contact with the fixing member, and a second blowing section that blows air against the recording material that has passed through the nip portion, wherein an air speed of air blown out from a first blowing outlet is higher than that of air blown out from a second blowing outlet, wherein an air flow amount from the first blowing outlet is less than that from the second blowing outlet, and wherein the first and second blowing outlets are arranged at a same positional height next to one another along a rotational axis of the fixing roller.

16 Claims, 11 Drawing Sheets

FIXING DEVICE THAT FIXES A TONER IMAGE ON A RECORDING MATERIAL

This application is based on Japanese Patent Application No. 2009-246284 filed on Oct. 27, 2009, which is incorporated hereinto by reference.

BACKGROUND OF THE INVENTION

The present invention relates to a fixing device that fixes a toner image on a recording material in a nip portion that is formed by a fixing member and a pressure-applying member.

In an image forming apparatus of an electrophotographic type such as a copying machine, a printer, a facsimile machine and a multifunctional peripheral equipped with various functions of the aforesaid items, a latent image corresponding to a document is formed, then, the latent image is visualized by receiving toner particles, and the visualized toner image is transferred onto a recording sheet and after that, the toner image transferred onto the recording sheet is fixed to be ejected.

As a fixing device that fixes a toner image in the aforesaid way, there is available a fixing device of a heat roller fixing type wherein a recording sheet onto which a toner image has been transferred is heated and is given a pressure in a nip portion that is formed by a fixing roller having therein a built-in halogen heater and by a pressure-applying roller that applies pressure to the fixing roller, while being interposed and conveyed, and the fixing device of this type is widely used because of its simple structure.

Further, there is available a fixing device of a belt-fixing type wherein a fixing belt in an endless form is trained about a heating roller having therein a built-in halogen heater and about a fixing roller, and a pressure-applying roller that applies a pressure to the fixing roller through the fixing belt is provided, and a recording sheet onto which a toner image has been transferred is heated and pressed while being interposed and conveyed in a nip portion that is formed by the fixing belt and the pressure-applying roller, and the fixing device of this type has an advantage that warming-up time is short because thermal capacity of the fixing belt is small, resulting in energy conservation.

In this case, since toner of the toner image on the recording sheet is heated when it passes through the nip portion, the toner has adhesion, and the recording sheet that has passed through the nip portion sticks to surfaces of the fixing roller and the fixing belt to wind itself around the fixing roller and the fixing belt, without being separated to cause a fear of occurrence of a jam. With respect to a recording sheet, in particular, when a sheet (thin paper) having small basis weight that is a coated paper for printing having small basis weight is used, releasing efficiency is more declined.

On the other hand, when a fixing roller is made to be greater for securing a sufficiently long nip width, to meet speeding up of an image forming apparatus, a curvature on the roller at a way out of a fixing nip is also made to be smaller, which declines the releasing efficiency.

For the purpose of obtaining easier separation of a recording sheet from the fixing member, there are taken various measures including using heat-resistance resins having high releasability for an outer layers of a fixing member, coating release agents such as silicon oil and making toner to contain wax that is dissolved by heating and functions as release agent. However, primary factors to lower releasing efficiency such as image forming on the aforesaid coated paper and adhesive force caused by an increase of toner amount caused by overlapping of plural colors which form color images, have been increased, which makes a separation auxiliary device to be indispensable.

As a separation device, there is available a method wherein a releasing claw that is coated with fluorocarbon resin having excellent releasability is provided on the sheet-ejection side for the recording sheet for the nip portion, and a tip portion of the releasing claw is caused to touch an outer surface of the fixing roller or the fixing belt, so that the recording sheet may be released from the fixing roller.

However, the aforesaid method has a problem that scratches are caused on an outer layer formed by fluorocarbon resin that covers a surface of the fixing roller, because the tip portion of the releasing claw is in contact with an outer layer of a surface of fixing roller, and the scratches are transferred also onto an image. In the case of color images, a surface of the fixing roller, in particular, these scratches are in a tendency to appear remarkably, because glossy images are required.

To deal with the problem of this kind, there has been developed a technology to cause a recording sheet to release from the fixing roller by blowing air against the way out side of the nip portion.

As an example of the foregoing, there is known a sheet releasing device that is corresponded to a high speed copying machine by storing compressed air generated by a compressor in two air boxes, and by jetting the compressed air through reciprocal opening and closing of two electromagnetic valves connected to the air boxes (see Unexamined Japanese Patent Application Publication No. S60-256180).

Further, there is known a sheet releasing device that can release a sheet without fail through a method wherein plural air bag manifolds that blow air in the circumferential direction of a soft roller are arranged, and when the first air blowing fails to release a sheet, the second air blowing releases the sheet (see Unexamined Japanese Patent Application Publication No. S61-62087).

There is further known a fixing device wherein a separating claw (a releasing claw) is provided, and air sent by a fan is blown against a nip portion (see Unexamined Japanese Utility model Application Publication No. S63-140571).

Further, there is known a releasing device wherein a releasing auxiliary plate is arranged to be close to a nip portion, and compressed air in a pulse form is discharged through a clearance between a fixing roller and the releasing auxiliary plate (see Unexamined Japanese Patent Application Publication No. 2004-212954).

In addition to the foregoing, there is known a fixing device wherein compressed air generated by a compressor is discharged through two electromagnetic valves, and when a leading edge of a recording sheet passes through a nip portion, high pressure compressed air is jetted, and after that, low pressure compressed air is jetted (see Unexamined Japanese Patent Application Publication No. 2007-86132).

Releasing of a recording sheet from a fixing roller by blowing air so that the fixed recording sheet may not stick to the fixing roller, is based on an area of the portion that receives the air blown against. When a toner image does not exist on the vicinity of the leading edge and when an area where no adhesive force is generated is broad, the leading edge of the sheet is released by "stiffness" and the empty weight of the sheet itself, and the area thus released receives air, which makes it possible to give a large releasing force. However, if images are in existence up to the vicinity of the leading edge of the sheet, a clearance formed between the leading edge of the sheet and an outer circumference of a fixing roller is extremely small, because the sheet follows in the tangential direction on an outer circumference of the fixing roller. For example, when the outer diameter of the fixing roller is 90 mm and a margin on the leading edge of the sheet is 3 mm, its clearance is only 0.1 mm. To make the leading edge of the sheet to be lifted by blowing air into the clearance, it is necessary to blow air having high air speed against the nip portion, in other words, to blow high pressure air against the nip portion, and for this purpose, compressed air generated to be at high pressure by a compressor is desirable.

A phenomenon that the recording sheet that has passed through the nip portion is not released and sticks to surfaces of the fixing roller and the fixing belt to wind itself around the surfaces of them takes place on the leading edge portion of the recording sheet and also takes place on other portions after the leading edge portion. Further, even when the leading edge of the recording sheet is drawn out by a sheet-ejection roller, uneven separation is caused on the twinning portion. Therefore, in the case of a structure to release a recording sheet by a fixing roller or the like by blowing air against the way out side of the nip portion, it is necessary to blow air continuously.

When blowing compressed air continuously as stated above, compressed air that is nearly equal to 0.01 $m^3/s$ is needed. For generating compressed air in this air flow amount, a high-power compressor of 5 to 10 kw is needed, because a lot of energy is required for generating compressed air, and there is a fear that a large-sized apparatus in a size of about 1 $m^3$, composed of a compressor and an air tank is not avoidable.

On the other hand, in the conventional documents, it is not possible to find out a structure that satisfies various related functions, while preventing a large size of the apparatus of this kind.

Namely, in Unexamined Japanese Patent Application Publication No. S60-256180, there is a fear that a large-sized apparatus composed of a high-power compressor as stated above is not avoidable.

In Unexamined Japanese Patent Application Publication No. S61-62087, there is a fear that a large-sized apparatus composed of a high-power compressor as stated above is not avoidable, because a plurality of air bag manifolds are arranged.

In Unexamined Japanese Utility model Application Publication No. S63-140571, although air sent by a fan is used, it is impossible to obtain high pressure air in this case, and combined use together with a releasing claw cannot be avoided. Therefore, the problem that scratches are caused on an outer layer of the fixing roller by the releasing claw is not solved.

In Unexamined Japanese Patent Application Publication No. 2004-212954, there is a fear that an image on a recording sheet is damaged by scratches, because of the construction wherein a recording sheet is separated by a sharp releasing auxiliary plate, after the leading edge of the recording sheet is released by compressed air.

In Unexamined Japanese Patent Application Publication No. 2007-86132, compressed air is made to be at low pressure after the leading edge of a recording sheet is released by compressed air. However, for maintaining releasing efficiency, sufficient air flow amount is needed, and when obtaining this air flow amount, there is a fear that a large-sized apparatus composed of a high-power compressor as stated above is not avoidable.

The present invention has been accomplished in view of the aforesaid problems, and its object is to suggest a fixing device with a structure to release the leading edge of a recording material by compressed air wherein a high-power compressor is not needed and the device is not enlarged and an image forming apparatus equipped with the aforesaid fixing device.

SUMMARY OF THE INVENTION

To achieve at least one of the abovementioned objects, a fixing device reflecting one aspect of the present invention is characterized in that the fixing device comprises a first blowing section that blows air against a neighborhood of the leading edge of a recording material that has passed through the aforesaid nip portion, in a fixing device that fixes a toner image on the recording material in a nip portion formed by a heated fixing member and a pressing member that is in pressure contact with the fixing member and a second blowing section that blows air against the recording material that has passed through the aforesaid nip portion, and an air speed of air that is blown out of a first blowing outlet (hereinafter, also referred to as a first air nozzle) provided on the aforesaid first blowing section is higher than an air speed of air blown out of a second blowing outlet (hereinafter, also referred to as a second air nozzle) provided on the aforesaid second blowing section, while, an air flow amount of air blown out of the aforesaid first blowing outlet is less than that of air blown out of the aforesaid second blowing outlet, and the aforesaid first blowing outlet and the second blowing outlet are arranged at the same position in the direction that is in parallel with a rotational axis of the aforesaid fixing member.

A fixing device reflecting another aspect of the present invention is characterized in that the fixing device comprises a first blowing section that blows air against a neighborhood of the leading edge of a recording material that has passed through the nip portion in a fixing device that fixes a toner image on the recording material in a fixing device that fixes a toner image on a recording material in a nip portion formed by a heated fixing member and a pressing member that is in pressure contact with the fixing member and a second blowing section that blows air against the recording material that has passed through the nip portion, and an air speed of air that is blown out of a first blowing outlet provided on the aforesaid first blowing section is higher than an air speed of air blown out of a second blowing outlet provided on the second blowing section, while, an air flow amount of air blown out of the first blowing outlet is less than that of air blown out of the second blowing outlet, and the aforesaid first blowing outlet and the second blowing outlet are arranged on the same surface in the direction that is in parallel with a rotational axis of the aforesaid fixing member.

DETAILED DESCRIPTION OF THE PREFERRED EMBODIMENT

Figure 1:
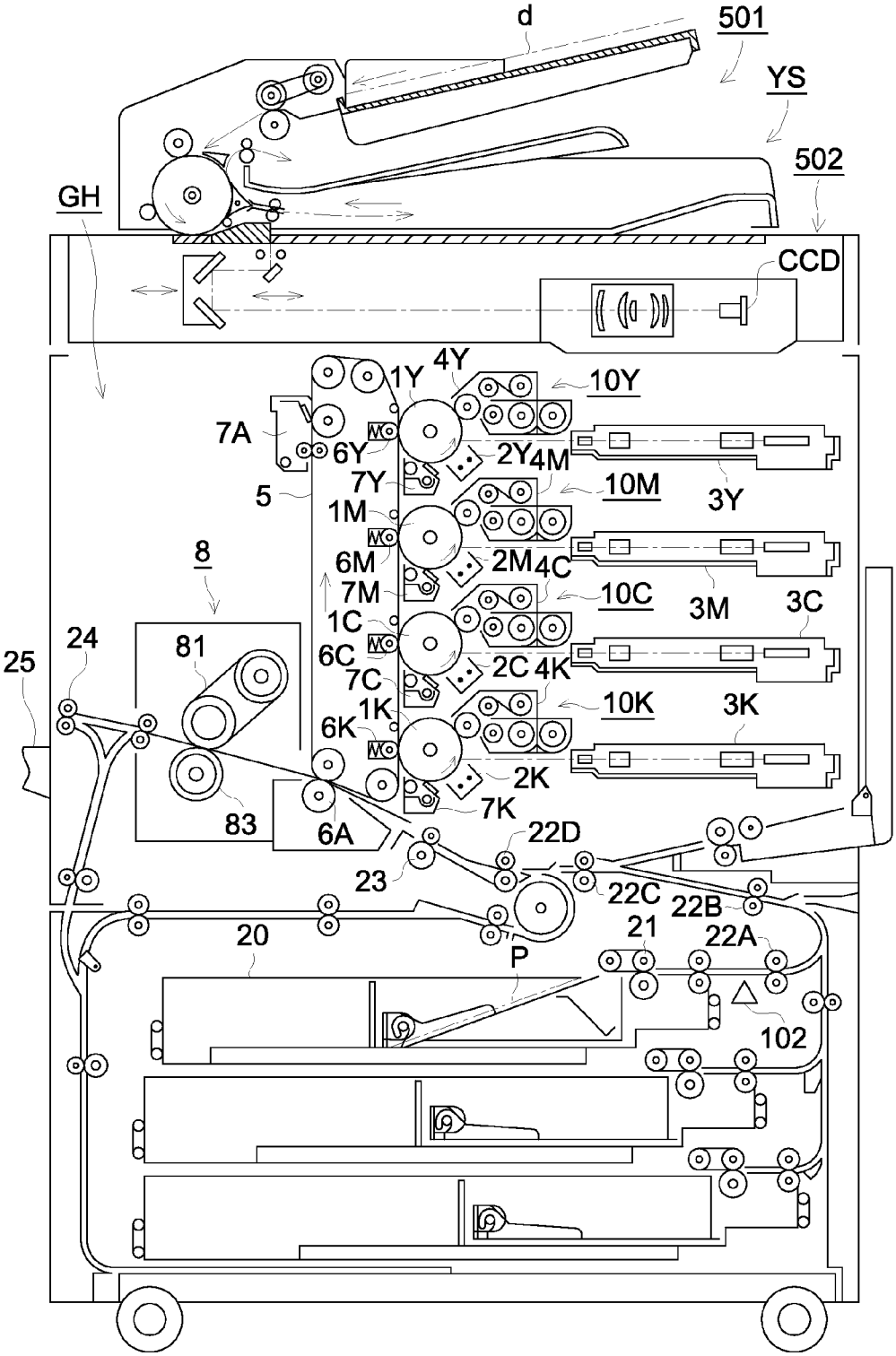
FIG. 1 is a schematic diagram of an image reading device.

Embodiments concerning the present invention will be explained as follows, referring to drawings.

First, an example of an image forming apparatus that uses the present invention will be explained as follows, based on a schematic diagram in FIG. 1.

The present image forming apparatus is composed of image forming apparatus main body GH and image reading device YS.

The image forming apparatus main body GH is an object that is called a color image forming apparatus of a tandem type, and it is composed of plural sets of image forming sections 10Y, 10M, 10C and 10K, belt-shaped intermediate transfer belt 5, sheet feeding conveyance device and belt conveyance device 8.

On the upper portion of the image forming apparatus main body GH, there is arranged the image reading device YS that is composed of automatic document feeder 501 and of document image scanning exposure device 502. Document "d" placed on a document platen of the automatic document feeder 501 is conveyed by a conveyance device, thereby, images on one side or both sides of the document are given scanning exposure by an optical system of the document image scanning exposure device 502, to be read in line image sensor CCD.

Signals formed by the line image sensor CCD through photoelectric conversion undergo analog processing, A/D conversion, shading correction and image compression processing, in an image processing section, and are sent to exposure devices 3Y, 3M, 3C and 3K.

On image forming section 10Y that forms a yellow (Y) color image, there are arranged, on a circumference of photoconductor drum 1Y, charging device 2Y, exposure device 3Y, developing device 4Y and cleaning device 7Y. On image forming section 10M that forms a magenta (M) color image, there are arranged, on a circumference of photoconductor drum 1M, charging device 2M, exposure device 3M, developing device 4M and cleaning device 7M. On image forming section 10C that forms a cyan (C) color image, there are arranged, on a circumference of photoconductor drum 1C charging device 2C, exposure device 3C, developing device 4C and cleaning device 7C. On image forming section 10K that forms a black (K) color image, there are arranged charging device 2K that is on a circumference of photoconductor drum 1K, exposure device 3K, developing device 4K and cleaning device 7K. And, a latent image forming device is composed of a combinations including a combination of the charging device 2Y and the exposure device 3Y, a combination of the charging device 2M and the exposure device 3M, a combination of the charging device 2C and the exposure device 3C and of a combination of the charging device 2K and the exposure device 3K.

Incidentally, the developing devices 4Y, 4M, 4C and 4K involve respectively two component developer that contains small particle size toner in yellow (Y) and carrier, two component developer that contains small particle size toner in magenta (M) and carrier, two component developer that contains small particle size toner in cyan (C) and carrier, and two component developer that contains small particle size toner in black (K) and carrier. The toner is composed of pigments or dyes each serving as color couplers, waxes that assist toner to release from a fixing member after fixing and binder resins which holds the aforesaid items.

The intermediate transfer belt 5 is trained about a plurality of rollers, to be supported to be rotatable.

The fixing device 8 fixes a toner image on recording sheet (recording material) P by heating the toner image and by applying pressure to the toner image in a nip portion that is formed between the heated fixing belt 81 and a pressure-applying roller (pressing roller) 83.

Thus, images in different respective colors formed respectively by image forming sections 10Y, 10M, 10C and 10K, are transferred onto rotating intermediate transfer belt 5 one after another by transfer devices 6Y, 6M, 6C and 6K (primary transfer), thereby, a toner image wherein color images are composed is formed. Recording sheet P loaded in sheet feed cassette 20 is fed by sheet feed device 21, and is conveyed to transfer device 6A through sheet feed rollers 22A, 22B, 22C, 22D and registration roller 23, so that a color image is transferred onto the recording sheet P (secondary transfer). The recording sheet P onto which the color image has been transferred undergoes heating and pressure-applying in fixing device 8, and a color toner image on the recording sheet P is fixed. After that, the recording sheet P is interposed by sheet ejection roller 24 to be placed on sheet ejection tray 25 that is located on the outer side of the apparatus.

On the other hand, after the color image has been transferred onto recording sheet P by transfer device 6A, residual toner on the intermediate transfer belt 5 is removed by cleaning device 7A from the intermediate transfer belt 5 from which the recording sheet P has been curvature-released.

Meanwhile, the foregoing has been for the image forming apparatus that forms a color image. However, the foregoing may also be for an image forming apparatus that forms a monochrome image, and the intermediate transfer belt may either be used or it may not be used.

Next, fixing device 8 relating to the present invention will be explained as follows based on a cross-sectional view of the fixing device of a belt-fixing type shown in FIG. 2.

Fixing belt 81 (fixing member) is formed to be in an endless form wherein, for example, 70 μm-thick PI (polyimide) is used as a substrate, then, an outer circumferential surface of the substrate is covered by 200 μm-thick heat-resistant silicone rubber (hardness JIS—A15°) as an elastic layer and is further covered by a tube of PFA (perfluoro alkoxy) that is 30 μm-thick heat-resistance resin. Its dimension of the outside diameter is, for example, 168 mm. As another constitution, it is also possible to use a metallic substrate such as nickel electrocasting for a substrate, to use fluorine-containing rubber for an elastic layer and to use a fluorine-containing resin coated layer such as PFA and PTFE (polytetra-fluoro ethylene) for a surface releasing layer.

Heating roller 82 houses therein halogen heater 82A serving as a heating device that heats fixing belt 81, and an outer circumferential surface of 4 mm-thick cylindrical sleeve 82B made of aluminum, for example, is covered by resin layer 82*c* that is coated with 30 μm-thick PTFE. Its dimension of the outside diameter is, for example, 90 mm. Incidentally, the halogen heater 82A is composed of for example, two 1200 W heaters, two 750 W heaters and one 500 W heater, and they are arranged so that heat generation distribution may vary in the axial direction to cope with different widths of recording sheet.

With respect to fixing roller 83, solid core 83A that is made of a metal such as iron is covered by 17 mm-thick heat-resistant silicone rubber (hardness JIS—A10°) as elastic layer 83B and is further covered by resin layer 83C that is coated with 30 μm-thick PTFE representing low frictional and heat-resistant resin. Its dimension of the outside diameter is, for example, 90 mm.

Pressure-applying roller 84 (pressing member) houses therein halogen heater 84A for the purpose of shortening a temperature-raising time immediately after power activation for an image output apparatus, then, an outer circumferential surface of 4 mm-thick cylindrical sleeve 84B that is made of aluminum is covered by 2 mm-thick heat-resistant silicone rubber (hardness JIS—A10°) as elastic layer 84C, and it is further covered by resin layer 84D of 30 μm-thick PFA tube. Its dimension of the outside diameter is 90 mm. Incidentally, wattage of the halogen heater 84A is, for example, 700 W.

In an unillustrated urging device, pressure-applying roller 84 presses fixing roller 83 through fixing belt 81.

In the aforesaid constitution, when the pressure-applying roller 84 is rotated counterclockwise by an unillustrated drive device, fixing belt 81 and heating roller 82 rotate clockwise, and fixing roller 83 also rotates clockwise. Incidentally, the fixing roller 83 may also be driven. Further, the fixing belt 81 is heated by halogen heater 82A through heating roller 82 that comes in contact, and pressure-applying roller 84 is also heated by halogen heater 84A. Then, since the pressure-applying roller 84 is urged in the direction of fixing roller 83, recording material P which has been fed is heated and applied with pressure in nip portion N that is formed between fixing belt 81 that is trained about fixing roller 83 and between pressure-applying roller 84, thus, the toner image on the recording material P is fixed.

Incidentally, fixing conditions, for example, are as follows.

Fixing load: 2000N

Fixing belt tension: 250N

Fixing belt control temperature: 160-200° C.

Pressure-applying roller control temperature: 80-120° C.

Recording sheet conveyance speed: 500 mm/s

Further, as a heating device for heating fixing belt 81, any type of heating device can be used, and, for example, a heating element of an induction heating type employing a magnetizing coil can be used. Further, a position where a heating device is mounted is not always limited to be in the heating roller 82.

It is further possible to provide a tension roller that gives tension to the fixing belt 81 and to provide a skew-control roller that controls meandering of a belt.

In the fixing device 8 mentioned above, recording material P needs to be released surely from the fixing belt 81, because there is a fear of occurrence of a jam if the recording material P that has undergone fixing sticks to the fixing belt 81 to twine the recording material around the fixing belt after the recording material is released from nip portion N.

Therefore, as the separating device of this kind, it has been thought to provide first air nozzle 201 (first blowing outlet) and second air nozzle 301 (second blowing outlet) in the vicinity of the outlet side of the nip portion N. The first air nozzle 201 is a nozzle through which compressed air generated through compression by a compressor is blown out, and air is blown for a short period of time against the vicinity of the leading edge of recording sheet P immediately after passing through the nip portion, thus, the leading edge portion of recording sheet P is separated from the fixing belt 81. On the other hand, the second air nozzle 301 is a nozzle through which air sent by a fan is blown out continuously, so that the recording sheet P whose leading edge portion is separated may not stick to the fixing belt 81.

Then, since air blown out of the first air nozzle 201 separates the leading edge of recording sheet P, an air speed of the air thus blown out needs to be high, but its air flow amount may be small in quantity because a time period for blowing out is short. On the other hand, with respect to air blown out of the second air nozzle 301, its air speed does not need to be high because its leading edge of the recording sheet P has been separated, but its air flow amount needs to be great because air is blown out continuously until the moment when the whole of the recording sheet P has been passed through the nip portion N. Incidentally, a quantity of air blown out of the first air nozzle 201 may be about one tenth of a quantity of air blown out of the second air nozzle 301. Because of this structure wherein the first air nozzle 201 and the second air nozzle 301 supplement each other, dimensions and power consumption in the present structure are about one tenth of those in the another occasion, resulting in downsizing and power saving, when it is compared with a construction of another occasion wherein the whole air is blown out of the first air nozzle 201, without providing the second air nozzle 301.

Recording sheet P separated from fixing belt 8, in this way, is guided by sheet ejection guide plate 85 to be conveyed. Meanwhile, even when the recording sheet P is pressed downward by air from the first air nozzle 201 and the second air nozzle 301, the recording sheet P does not twine itself around pressure-applying roller 84, because releasing claw 86 that is made of heat-resistant resin is in pressure contact with pressure-applying roller 84. Further, with respect to the releasing claw 86, its front edge section in length of about 10 mm, for example, is coated with fluorine-containing resin to be excellent in terms of lubricating property, and the releasing claw 86 is in pressure contact with pressure-applying roller 84 under low pressure of about 1 mN. Therefore, the pressure-applying roller 84 does not get scratched. In addition, even when a toner image is positioned on the pressure-applying roller 84 side in the case of two-sided copying, the toner image is not melted because a temperature of the pressure-applying roller 84 is low, thus, defective images are not caused by the releasing claw 86.

Further, for the purpose of keeping the pressure-applying roller 84 to be at a low temperature, it is possible to control an amount of heat transmission from fixing belt 81 to pressure-applying roller 84 by making a distance between transfer device 6A and fixing device 8 to be a length that is the maximum of the length of recording sheet P or more, and by shortening a space between sheets in the aforesaid distance. It is further possible to cool an inner circumference and an outer circumference of the pressure-applying roller 84 by a fan.

Further, with respect to the releasing claws 86, it is possible to use those which have been used for the traditional fixing devices.

Next, constitution for blowing out air from the first air nozzle 201 and from the second air nozzle 301 will be explained as follows, based on block diagrams shown in FIGS. 2 and 3.

The first air nozzle 201 is connected to electromagnetic valve 203 through pipe 202, that lets air flow the electromagnetic valve 203 is connected to air tank 204 through the similar pipe and the air tank 204 is connected to compressor 205 through the similar pipe.

Incidentally, the constitution composed of the first air nozzle 201, the pipe 202, the electromagnetic valve 203, the air tank 204 and of compressor 205 is called first blowing device 200.

In this case, the electromagnetic valve 203 is of a direct-acting type, and capacity of the electromagnetic valve 203 is 0.001 $m^3/s$ (100 kPa) and a response speed thereof is 20 ms.

A capacity of the air tank 204 is 0.05 $m^3$.

The compressor 205 is of a reciprocating-oil-free type, and its electric power is 0.75 kw, static pressure is 0.8 MPa and air flow amount is 0.00125 $m^3/s$.

In the image forming apparatus shown in FIG. 1 having the aforesaid constitution, sheet feed sensor 102 detects that recording sheet P stored in sheet feed cassette 20 is fed by sheet feed device 21. A period of time for the conveyed recording sheet P from the moment of the detection by the sheet sensor 102 to the moment when the recording sheet P has passed through the nip portion is fixed and is known in advance, and when controller 101 composed of CPU recognizes that the period of time has elapsed by timer 103, it transmits opening signals to the electromagnetic valve 203, and then, transmits closing signals after 50 ms. Since compressed air compressed by compressor 205 to a level of about 0.8 MPa is pooled in air tank 204 in advance, the compressed air is blown out of the first air nozzle 201 when the electromagnetic valve 203 is opened to blow against the leading edge of recording sheet P that is immediately after passing through nip portion N.

Pressure of blowing out from the first air nozzle 201 is 0.1 to 0.2 MPa, an air speed is 100 to 160 m/s and an air flow amount is 0.005 to 0.008 $m^3/s$.

Further, since the electromagnetic valve 203 becomes to be in the full opening state of after about 20 ms from inputting of the open signals, an air flow amount arrives at its maximum air flow amount at the moment when recording sheet P has been conveyed for about 10 mm from the nip portion. Since the maximum amount for compressed air blown out of the first air nozzle 201 is twice to three times that of the air flow amount needed for separating recording sheet P, recording sheet P starts separating before an amount of compressed air blown out arrives at its maximum value, namely, before a distance of conveyance from nip portion N arrives at 10 mm. After that, when closing signals are inputted in electromagnetic valve 201, an amount of compressed air blown out of the first air nozzle 201 is reduced gradually, and blowing out is continued until the moment when the leading edge of the recording sheet P arrives at a position that is 25 to 30 mm from the nip portion N. A quantity of air blown out in this case is an air flow amount that can release recording sheet P even when there is a toner image having the maximum amount of adhesion.

After blowing out compressed air from the first air nozzle 201, and thereby separating the leading edge of recording sheet P having passed through nip portion N from fixing belt 81 as stated above, blowing out of compressed air is stopped, instead, air sent by a fan from the second air nozzle 301 is blown out continuously to blow against recording sheet P to prevent sticking of recording sheet P to fixing belt 81.

Namely, when separation of recording sheet P advances to a certain extent, and when the leading edge of recording sheet P is opened from fixing belt 81 by 0.2 mm or more, lower pressure but in greater quantity of air blowing against a broader area is more desirable than air at higher pressure and blowing against a narrower range like compressed air blown out of the first air nozzle 201, for the purpose of giving releasing force to the whole opened area. Therefore, blowing out of air from the first air nozzle 201 is stopped, and air sent by a fan from the second air nozzle 301 is blown against the leading edge released from fixing belt 81 on recording sheet P. Owing to this, a force is applied on recording sheet P, defying the adhesive power of toner, and the recording sheet P is surely separated from fixing roller 81 even in the case of no blowing from the first air nozzle 201.

Further, in an image forming apparatus shown in FIG. 1, when sheet feed sensor 102 detects that recording sheet P stored in sheet feed cassette 20 is fed by sheet feed device 21, controller 101 turns on electricity for switch for fan 304. Therefore, fan 303 starts rotating to blow out air at a speed of 20 m/s, for example, from the second air nozzle 301 through duct 302, to blow against recording sheet P, and separates recording sheet P from fixing belt 81. When fixing recording sheets P continuously, the fan 303 is kept to rotate, but when the response of fan 303 is high sufficiently as will be described later, ON/OFF of switch for fan 304 may be repeated, synchronizing with entrance of recording sheet P.

Incidentally, fan 303 is an axial flow fan whose size is 40 millimeters square, whose electric power is 12 W and whose static pressure is 500 Pa.

Further, a second air nozzle 301, duct 302, fan 303 and switch for fan 304 are called second blowing device 300.

The reason why electricity is turned on for switch for fan 304 before the recording sheet P arrives at fixing device 8 is because there is a time lag from the moment when electricity is turned on for fan 303 to the moment when the fan 303 arrives at its maximum revolutions per minute. If the fan 303 can arrive at its sufficient air speed to continue separation which will be described later before the recording sheet P arrives at the position to be separated because of the reason that the recording sheet conveyance speed is low, it is possible to turn on electricity after the recording sheet P arrives at a fixing device. In contrast to this, when using a blower that is of a high power but has a long rise time as fan 303, such as an occasion to apply the present invention to a high-speed image forming apparatus, it is possible to select properly startup timing of fan 303, such as starting of a blower in advance of a start of sheet feeding for an image forming apparatus, further in advance of image forming operations.

Further, pressure of blowing out from the second air nozzle 301 is 400 Pa, an air speed is 20 to 30 m/s and an air flow amount is 0.025 to 0.04 $m^3/s$.

In addition, fan 303 is not limited to the axial flow fan alone, and it may also be sirocco fan or a cross flow fan, or even a blower, and the point is that the fan has only to have conditions to own an air flow amount that can release continuously recording sheet P whose leading edge has been separated from fixing belt 81. Then, a form of duct 302 is established based on a style of fan 303.

In this case, for the purpose of blowing air blown out from the first air nozzle 201 and the second air nozzle 301 against recording sheet P efficiently, it is desirable that both nozzles are positioned to be as close as possible to the vicinity of the outlet of the nip portion N. However, in the case of the constitution shown in FIG. 2, it is impossible to position them to be too close to the vicinity of the outlet of the nip portion N, because two nozzles for the first air nozzle 201 and the second air nozzle 301 are arranged in the vertical direction and each nozzle has its own prescribed thickness.

Figure 4:
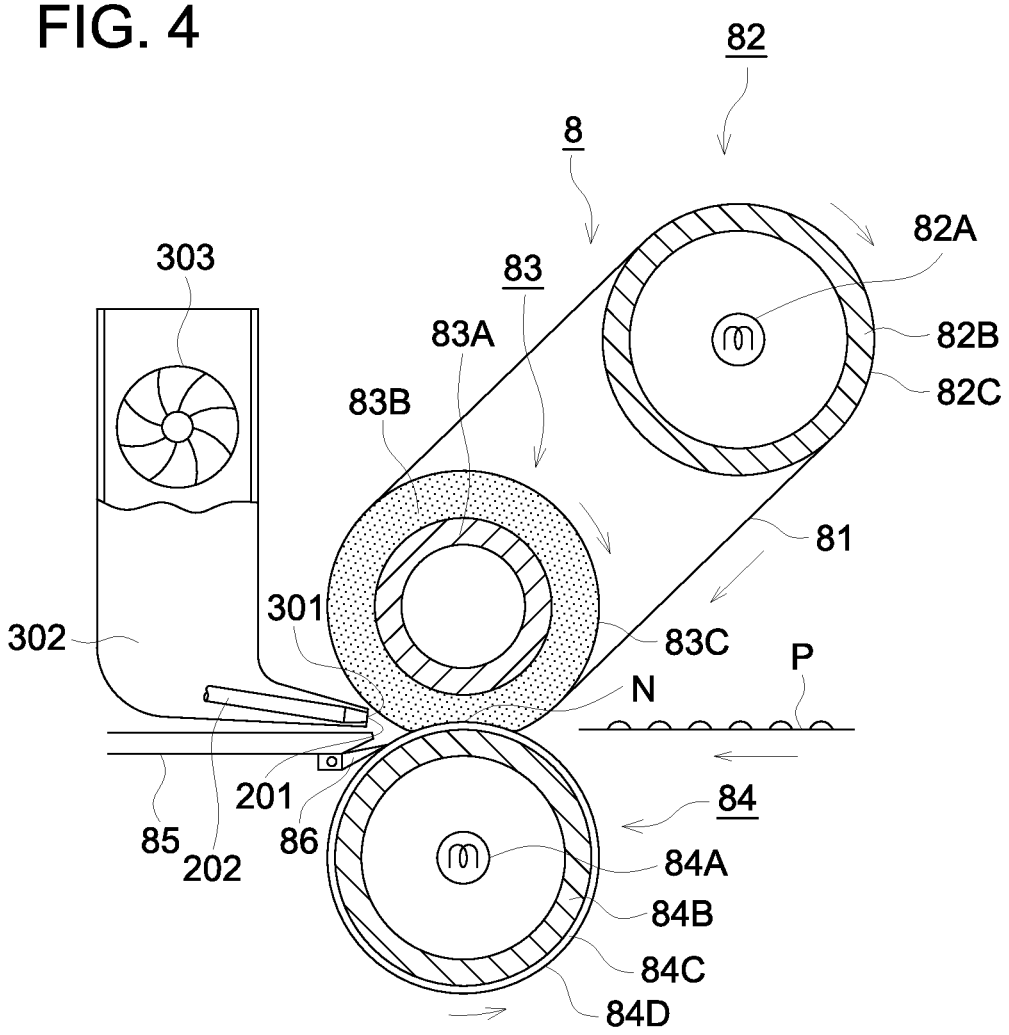
FIG. 4 is a cross-sectional view of a fixing device of a belt-fixing type wherein a first air nozzle and a second air nozzle are arranged at the same position.

Therefore, as is shown in FIG. 4, it has become possible to make the first air nozzle 201 and the second air nozzle 301 to be more close to the vicinity of the outlet of the nip portion N, by positioning the first air nozzle 201 and the second air nozzle 301 at the same position in the direction that is in parallel with a rotational axis of fixing belt.

By causing respective air nozzles to be close to the vicinity of the outlet of the nip portion N as stated above, an air speed in advance and an air flow amount is increased, and releasing efficiency is improved. If the existing air speed and air flow amount for releasing are sufficient, electric powers for compressor 205 and for fan 303 can be lowered, which makes power saving to be possible.

Figure 5A:
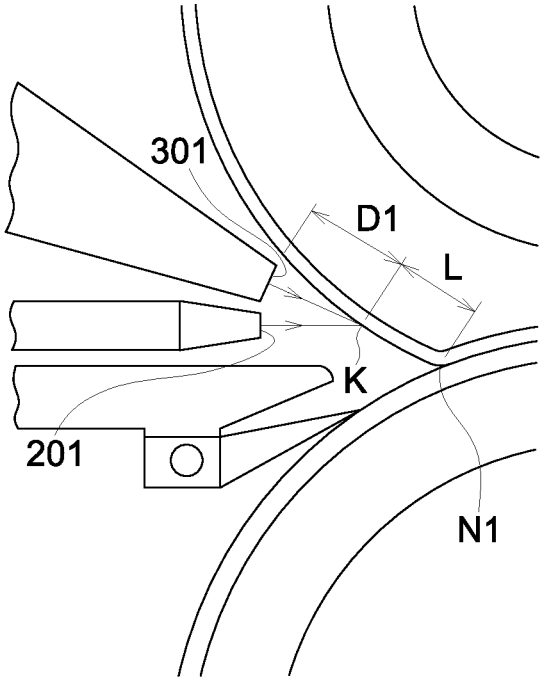
FIGS. 5A-5B are diagrams of comparison between FIG. 2 and FIG. 4 relating respectively to the first air nozzle and the second air nozzle.
Figure 5B:
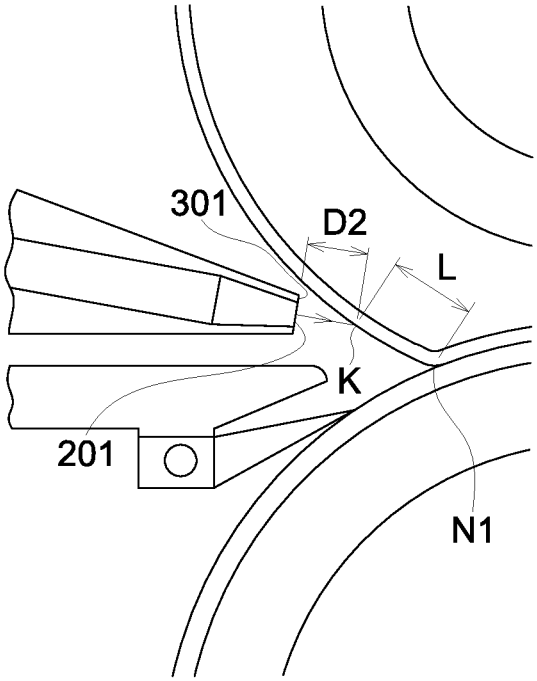

Differences of the aforesaid constitutions will be compared and explained based on enlarged diagrams of FIG. 5A and FIG. 5B.

Figure 2:
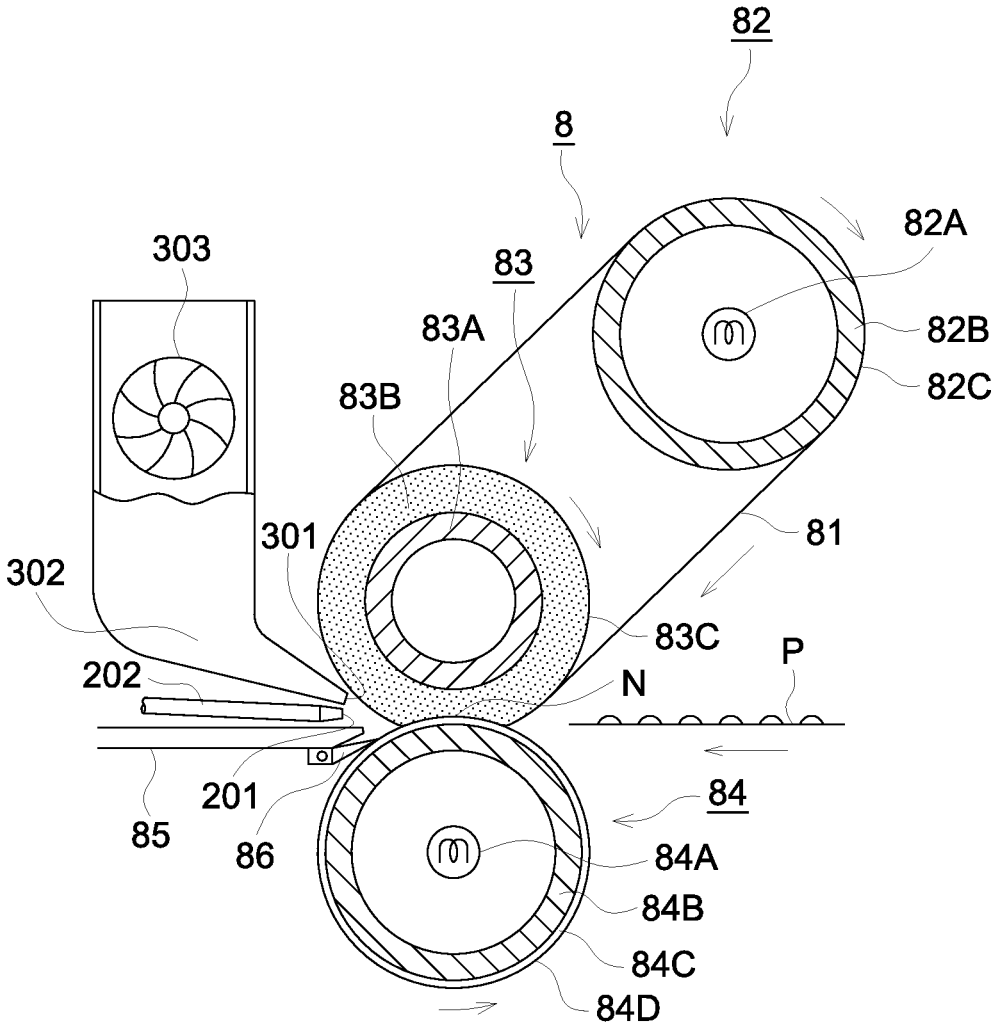
FIG. 2 is a cross-sectional view of a fixing device of a belt-fixing type wherein a first air nozzle and a second air nozzle are arranged at different positions.
Figure 3:
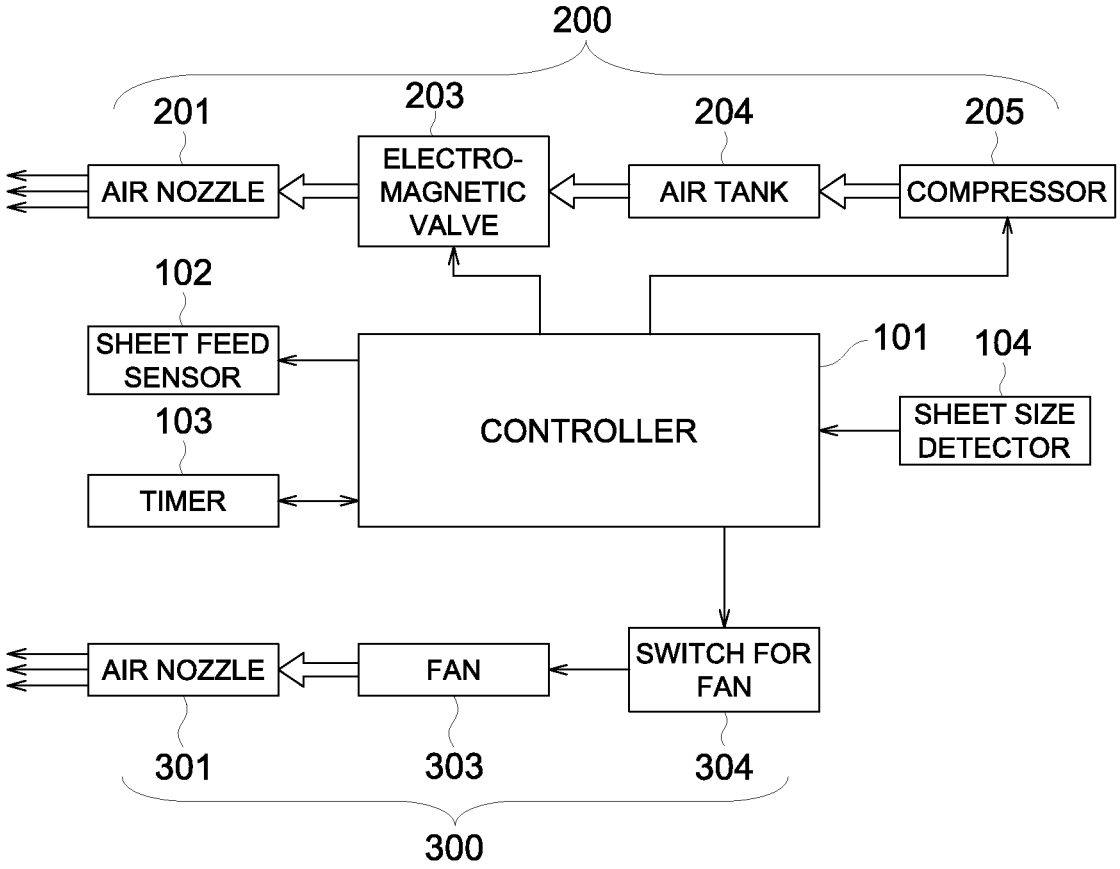
FIG. 3 is a block diagram for controlling a compressor and a fan.

FIG. 5A is an enlarged diagram for the first air nozzle 201 and the second air nozzle 301 corresponding to FIG. 2, while, FIG. 5B is an enlarged diagram for the first air nozzle 201 and the second air nozzle 301 corresponding to FIG. 4. N1 represents the outlet of the nip portion and K represents a blowing position to blow air, and length L from N1 to K is made to be, for example, 10 mm. In FIG. 5A, length D1 from blowing position K to the second air nozzle 301 is about 15 mm, but in FIG. 5B, length D2 from blowing position K to the second air nozzle 301 is about 7.5 mm. By arranging the first air nozzle 201 and the second air nozzle 301 at the same position as stated above, it is possible to make the first air nozzle 201 and the second air nozzle 301 to be closer to outlet portion N1 of the nip portion.

Incidentally, in FIGS. 5A and 5B, the outside diameter of each of fixing roller 83 and pressure-applying roller 84 is 90 mm.

In experiments wherein a length from K to the second air nozzle 301 has been changed from 15 mm to 7.5 mm, it was possible to secure the air speed and the air flow amount which are the same as those in traditional ways even when electric power of each of compressor 205 and fan 303 was reduced by about 20 percent. If the length D2 from K to the second air nozzle 301 is made to be 7.5 mm to increase the air speed and air flow amount without changing electric power for the compressor 205 and fan 303, it becomes possible to release ordinarily also a recording sheet whose basis weight is smaller than that in the past and whose stiffness is low. Namely, it was possible to magnify a lower limit of Clark stiffness of a recording sheet that can be separated from 30 $cm^3$/100 to 15 $cm^3$/100. Incidentally, a measuring method for Clark stiffness is prescribed in "JIS P 8143".

Various types of embodiments relating to the first air nozzle 201 and the second air nozzle 301 arranged at the same position as stated above will be explained as follows.

Figure 6:
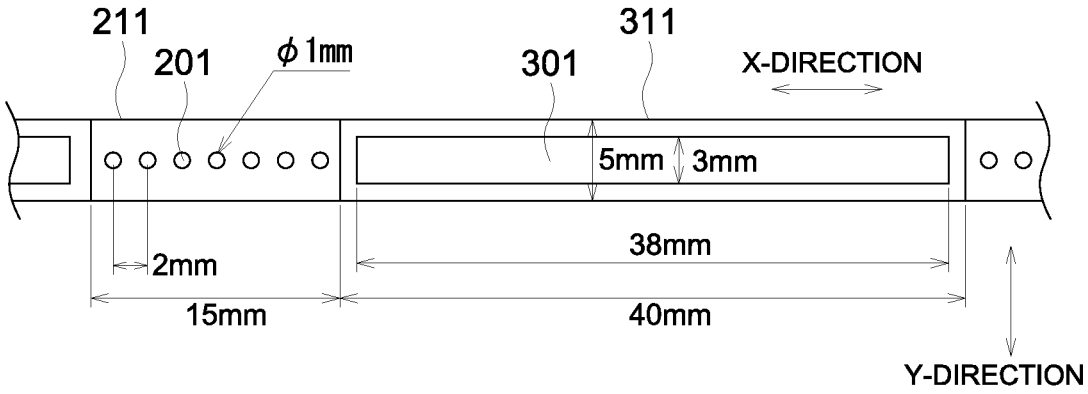
FIG. 6 is a diagram wherein the first air nozzles and the second air nozzles are arranged alternatively in the direction that is in parallel with a rotational axis a fixing belt.

FIG. 6 is a partial enlarged diagram of the first air nozzle 201 and the second air nozzle 301 which are viewed in the direction of the nip portion N.

In FIG. 6, the first air nozzles 201 and the second air nozzles 301 are arranged alternately in direction X that is in parallel with a rotational axis of fixing belt 81. For details, first air guide sections 211 on which a plurality of first air nozzles 201 are provided and second air guide sections 311 on which second air nozzles 301 are provided are arranged alternately in the direction X.

By arranging the first air nozzles 201 and second air nozzles 301 by putting them in order in the direction X as stated above, namely, by arranging them at the same position, it is possible to make the first air guide sections 211 and second air guide sections 311 to be close to nip portion N, without overlapping each other, as shown in FIG. 2. Therefore, it is possible to reduce air speed and air flow amount, in comparison with FIG. 2, resulting in reduction of electric power for compressor 205 and fan 303, and also in downsizing dimensionally. Further, if electric power is not changed, air speed and air flow amount are increased and releasing efficiency is improved.

As an example, the first air guide section 211 on which 7 first air nozzles 201 each being 1 mm in terms of a diameter are provided at a pitch of 2 mm and second air guide section 311 on which a second air nozzle 301 that is 38 mm in X direction and is 3 mm in Y direction that is perpendicular to X direction is provided are arranged alternately in X direction. In this case, the number of the first air guide sections 211 is 5 and the number of the second air guide sections 311 is 6.

Meanwhile, since air blown out of the first air guide section 211 is blown in the direction of a width of recording sheet P discretely, an amount of separation from fixing belt 81 is reduced in the case of recording sheet P which is not blown directly by air. Therefore, it is not preferable that a distance between two first air guide sections 211 is too great. Even in the case of recording sheet that is not blown directly by air blown out of the second air guide section 311, an amount of separation from fixing belt 81 is reduced. Therefore, it is not preferable that a distance between two second air guide sections 311 is too great. Therefore, it is preferable that dimensions in X direction of the first air guide section 211 are 10 to 20 mm, and that the first air nozzles 201 each being 1 mm in terms of diameter are set to be in number of 5 to 10 at a pitch of 2 mm. Further, it is preferable that dimensions in the X direction of the second air guide section 311 are 30 to 40 mm.

Figure 7:
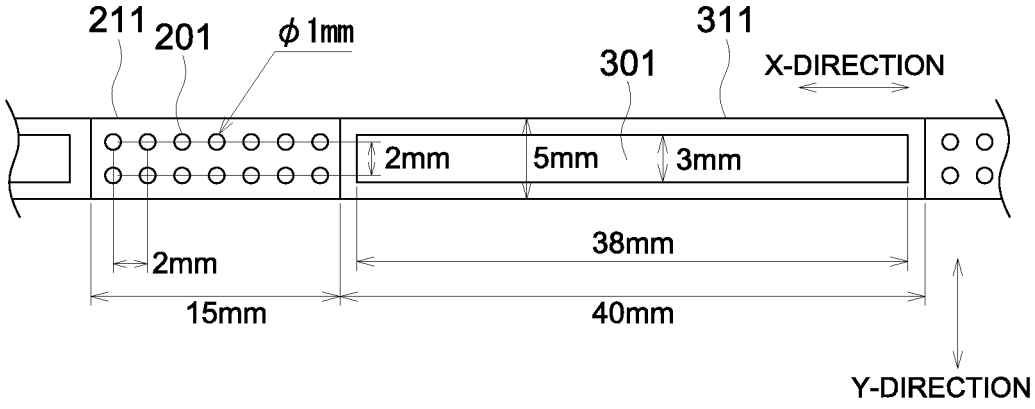
FIG. 7 is an example of a variation of FIG. 6.

FIG. 7 is a diagram wherein the number of the first air nozzles 201 is increased to be more than that in FIG. 6.

In FIG. 7, the first air nozzles 201 each being 1 mm in terms of diameter are arranged continuously at intervals of 2 mm in X direction to form two rows vertically. Due to this, a quantity of air blown out of the first air nozzle 201 is doubled, and releasing efficiency is more improved. However, an angle of each first air nozzle 201 needs to be established properly so that air blown out of the first air nozzle 201 on the upper row and air blown out of the lower row may be blown against the same blowing position K of fixing belt 81.

Figure 8:
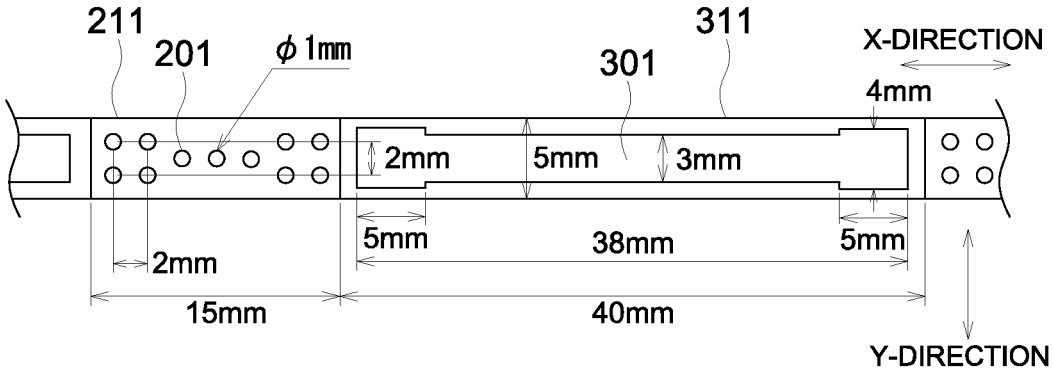
FIG. 8 is an example of a variation of FIG. 6.

FIG. 8 is a diagram wherein the number of the first air nozzle 201 has been increased partially to be more than that in FIG. 6, and a width of the second air nozzle 301 has been enlarged partially.

Namely, in the first air guide section 211, with respect to density on the first air nozzle 201, density on an end portion close to the second air guide section 311 is higher than that on a central portion, and in the second air guide section 311, concerning a width of the second air nozzle 301 in the direction perpendicular to the rotational axis of fixing belt 81, a width on an end portion close to the first guide section 211 is wider than that on the central area. As an example, the first air nozzles 201 positioned at an end portion are arranged continuously in the X direction to form two rows, to increase by 4 from that in FIG. 6, and a width of the second air nozzle 301 positioned at an end portion is enlarged partially to 3 mm or to 4 mm. Owing to this, it is possible to increase air flow amount in a boundary between the first air nozzle 201 and the second air nozzle 301, thus, it is possible to lessen more an area which is not blown by air.

Figure 9:
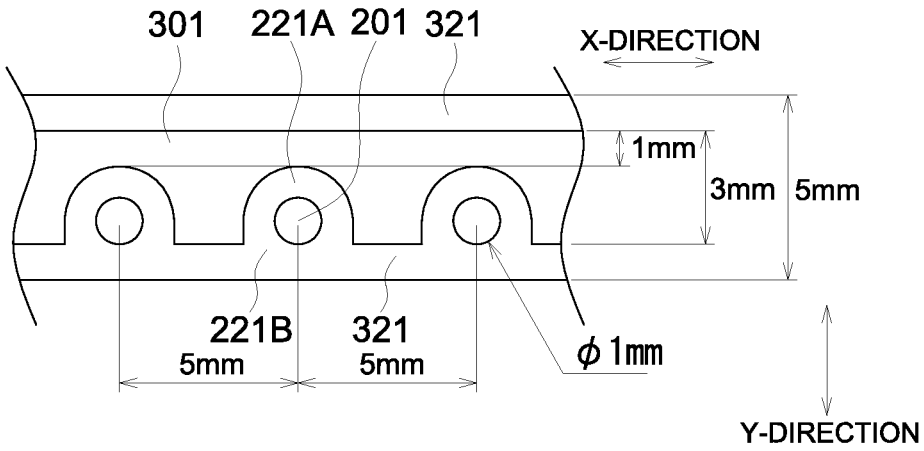
FIG. 9 is a diagram wherein a circumferential wall that forms a first air nozzle and a circumferential wall that forms a second air nozzle are formed solidly to be one body.

Next, a first air nozzle 201 and a second air nozzle 301 which are constituted differently from those shown in FIGS. 6 to 8. FIG. 9 is a partially enlarged diagram wherein the first air nozzle 201 and the second air nozzle 301 are viewed from nip portion N.

In FIG. 9, the second air nozzle 301 is made to be in a length that can cope with the maximum width of recording sheet P to be fixed in the X direction that is in parallel with a rotational axis of fixing belt 81, and it is made to be in a width of 3 mm in the Y direction that is perpendicular to X direction. Inside the second air nozzle 301, circumferential wall 221A that is mostly in a semicircular form that is a part of a circumferential wall of the first air nozzle 201 that forms the first air nozzle 201, is protruded. Then, plural number of the first air nozzles 201 are arranged at intervals of 5 mm in the X direction. In other words, the circumferential wall 221A that is mostly in a semicircular form and forms the first air nozzle 201 and another circumferential wall 221B are formed integrally with circumferential wall 321 that forms the second air nozzle 301.

By causing the second air nozzle 301 to involve the first air nozzle 201 as stated above, a width in Y direction including both air nozzles is narrowed, and thereby, they can be positioned to be close to nip portion N. Therefore, it is possible to reduce air speed and air flow amount, in comparison with an occasion where the first air nozzle 201 and the second air nozzle 301 are arranged as shown in FIG. 2, resulting in reduction of electric power for compressor 205 and fan 303, and also in downsizing dimensionally. Further, if electric power is not changed, air speed and air flow amount are increased and releasing efficiency is improved. In addition, releasing and separation can be carried out stably because air can be blown to the whole width of recording sheet P.

Further, an air course covering from air tank 204 to the first air nozzle 201 and an air course covering from fan 303 to the second air nozzle 301 are formed separately, therefore, air flows for both of them are not interfered each other.

Further, in this case, plural (for example, 8) fans 303 corresponding to the second air nozzle 301 are arranged in X direction, and it is desirable that partition walls are provided in duct 302. Due to this, air flows are not disturbed by others, and air is blown out of the second air nozzle 301 in the rectified state.

Figure 10:
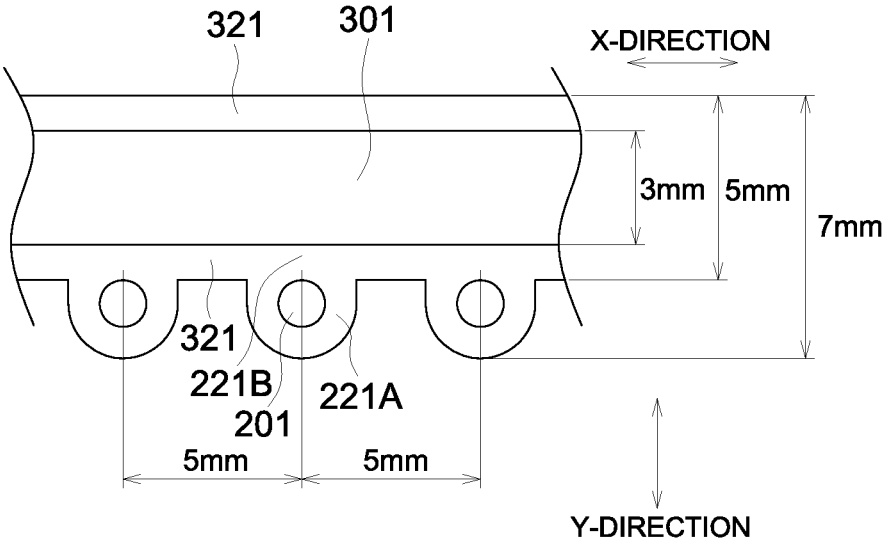
FIG. 10 is a diagram wherein a circumferential wall that forms a first air nozzle and a circumferential wall that forms a second air nozzle are formed solidly to be one body.

FIG. 10 is a diagram wherein the first air nozzle 201 is arranged on the outside of the second air nozzle 301, to be different from FIG. 9. In FIG. 10, circumferential wall 221A that is mostly in a semicircular form and forms a part of the first air nozzle 201, is protruded to the outside from circumferential wall 321 that forms the second air nozzle 301. And, the circumferential wall 221A that is mostly in a semicircular form and other circumferential wall 221B are formed integrally with circumferential wall 321 that forms the second air nozzle 301.

In this case, the second air nozzle 301 does not become small, and sufficient air flow amount can be secured, because the circumferential wall 221A is not positioned in the second air nozzle 301 as shown in FIG. 9. However, bringing a nozzle closer to the nip portion is more difficult than in FIG. 9, because a dimension in Y direction is greater than that in FIG. 9. However, when comparing with an occasion wherein a circumferential wall forming the second air nozzle 301 in Y direction, prescribed clearances, a circumferential wall forming the first air nozzle 201 are arranged, it is extremely easy to bring a nozzle close to the nip portion N, because circumferential walls 221A, 221B and 321 are in one body.

Figure 11:
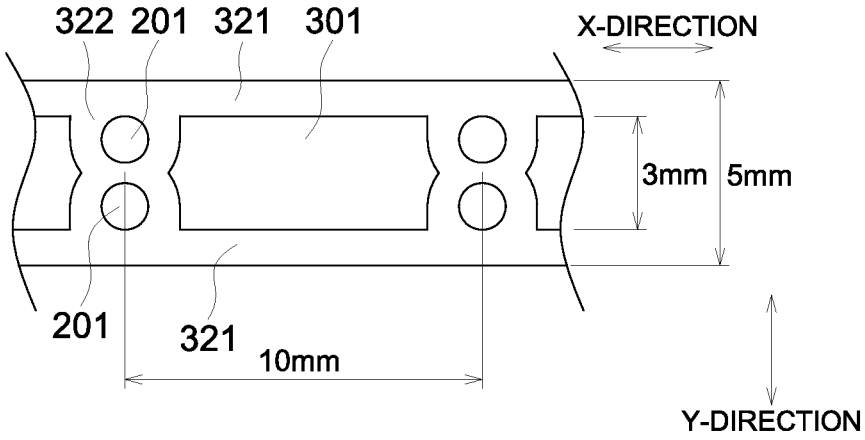
FIG. 11 is an example of a variation of FIG. 9.

FIG. 11 is a diagram wherein two first air nozzles 201 are arranged in Y direction within the second air nozzle 301, which is different from FIG. 9.

In FIG. 11, opposing circumferential walls 321 that form the second air nozzle 301 are connected in Y direction by connecting section 322, and plural connecting sections 322 are provided in X direction intermittently. On each of the connecting section 322, there are provided two first air nozzles 201 in Y direction. When FIG. 11 is compared with FIG. 9 in terms of structure, the total number of first air nozzles 201 is the same, but the point where the second air nozzle 301 is intercepted into plural nozzles is different. However, air flow amount is increased because an aperture area of the second air nozzle 301 is large. Further, when the connecting section 322 that connects circumferential walls 321 is provided, structural strength is increased, which makes it possible to control warping and vibration. Even in this case, it is necessary to establish an angle of each first air nozzle 201 properly so that air flows blown out of two first air nozzles 201 in Y direction may be blown against the same blowing position K.

In the case of FIGS. 9 to 11 mentioned above, the first air nozzle 201 is arranged in the second air nozzle 301 or in the circumferential wall to be unified in the structure. Therefore, these cases are also called an occasion wherein the first air nozzle 201 and the second air nozzle 301 are arranged at the same position.

Figure 12:
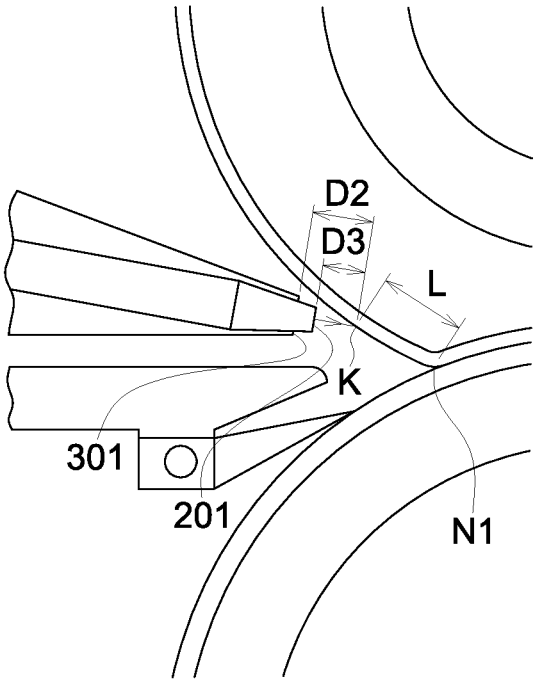
FIG. 12 is a diagram wherein the first air nozzle is protruded from the second air nozzle toward the nip portion.

It is further possible to arrange the first air nozzle 201 to be closer to the nip portion N than the second air nozzle 301 is, as shown in FIG. 12, which is an example of a variation that is common to the structures shown in FIGS. 6 to 11. For example, when a length from the blowing position K to the second air nozzle 301 is 7.5 mm, it is possible to make length D3 from the blowing position K to the first air nozzle 201 to be about 5.5 mm. Due to this, an air speed from the first air nozzle 201 is enhanced, and separation of recording sheet P becomes to be easier. Further, if the air speed from the first air nozzle 201 is sufficient as it is, it is possible to lower the electric power of compressor 205.

Concerning the structures shown in FIGS. 6 to 11, a plurality of the first air nozzles 201 and a plurality of the second air nozzles 301 need to be arranged respectively to be in parallel with a rotational axis of fixing belt 81, and if they become warped or are twisted partially, it is impossible to blow out air uniformly against recording sheet P. Therefore, in FIGS. 6 to 8, it is desirable that the first air guide section 211 and the second air guide section 311 are unified integrally, and a manufacturing method for casting both air guide sections integrally through die casting, for example, is considered. Even in the case of FIGS. 9 to 11, die casting is equally preferable.

Meanwhile, when manufacturing the first air guide section 211 and the second air guide section 311 as separate items, it is desirable that both air guide sections are fixed on a metal substrate such as a metal plate of steel or stainless steel on which the strength and flatness are secured. In addition, a tip of the metal plate is arranged to be retreated from the positions for the first air nozzle 201 and the second air nozzle 301, so that the metal plate may not disturb that the first air nozzle 201 and the second air nozzle 301 are arranged to be close to the nip portion. Further, for the purpose of aligning plural tips for the first air nozzle 201 and the second air nozzle 301 to be on a straight line, it is desirable that the first air guide section 211 and the second air guide section 311 are positioned on the metal plate by providing positioning sections on the first air guide section 211 and the second air guide section 311. It is further possible to provide a convex portion and a concave portion on side walls of the first air guide section 211 and the second air guide section 311 which adjoin each other, so that the convex portion and the concave portion may be engaged each other and may serve as positioning members.

Figure 13:
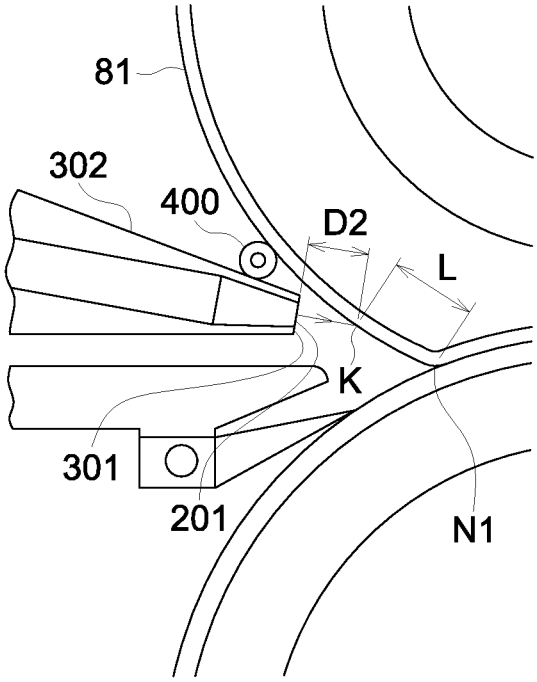
FIG. 13 is a diagram wherein a roller is arranged between the second air nozzle and the fixing belt.

Incidentally, the more closer the first air nozzle 201 and the second air nozzle 301 are brought to the nip portion, the more the releasing efficiency is improved. However, if they are positioned to be too close, there is a fear that the first air nozzle 201 and the second air nozzle 301 will come in contact with fixing belt 81, because of thermal expansion of fixing roller 83, rattling of fixing belt 81 in the case of rotation, or of vibration of duct 302. In this case, the first air nozzle 201 and the second air nozzle 301 may be arranged at the position having rooms to avoid the aforesaid influences, but in some cases, there is an occasion to bring the first air nozzle 201 and the second air nozzle 301 to be close to the nip portion N as far as possible. In this case, it is preferable that a rotatable roller 400 having a supporting shaft in the direction that is in parallel with a rotational axis of fixing belt 81 is arranged between the fixing belt 81 and duct 302 as shown in FIG. 13. Owing to this, even when fixing roller 83 expands thermally, there is no fear that the second air nozzle 301 comes in contact with fixing belt 81. Further, for controlling vibration of duct 302, it is desirable to create the structure wherein fan 303 is supported through vibration-preventing materials. It is further possible to enhance stiffness of duct 302 to make an amplitude of vibration to be small, by providing a rib on duct 302 or by increasing a thickness of structural members.

Figure 14:
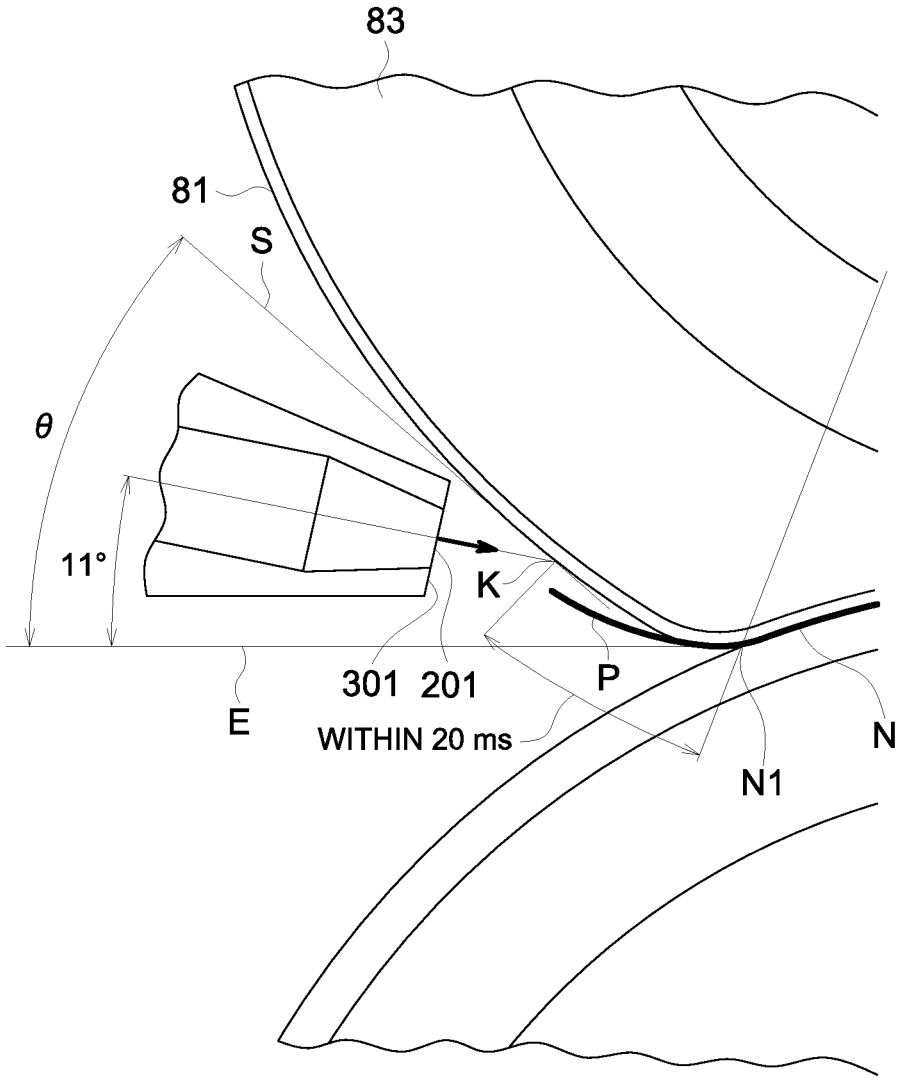
FIG. 14 is an enlarged diagram showing blowing positions for the first air nozzle and the second air nozzle.

In an image forming apparatus equipped with fixing device 8 having the aforesaid first air nozzle 201 and the second air nozzle 301, an example of a process to form images by feeding recording sheets P in A4 size at a speed of 100 ppm will be explained in detail, referring to an enlarged diagram in FIG. 14

When sheet feed sensor 102 detects that recording sheet P stored in sheet feed cassette 20 has been fed by sheet feed device 21, controller 101 turns on electricity for switch for fan 304 to start rotation of fan 303 to blow out air from the second air nozzle 301 at about 20 m/s.

In experiments, it is made public that when recording sheet P is released after its leading edge section winds itself around fixing belt 81 in a period of time of 20 ms or more, the longer the winding time is, the more image unevenness considered to be caused by changes of releasing state is generated, and, the more, image appearance quality is lowered, accordingly.

Therefore, it is necessary for the leading edge portion of recording sheet P to be released within 20 ms after the leading edge portion of recording sheet P is conveyed from outlet portion N1 of nip portion N. Therefore, the blowing position K by the first air nozzle 201 and the second air nozzle 301 are set so that a period of time may be within 20 ms after the leading edge of recording sheet P is conveyed from nip outlet N1 of the nip portion N. Further, in other experiments, if a margin on the leading edge of recording sheet P is 3 mm, an air flow from the first air nozzle 201 is required to be a flow along fixing belt 81, because a clearance between the leading edge of recording sheet P and fixing belt 81 is only about 0.1 mm. If the direction of blowing from the first air nozzle 201 is assumed to agree with tangent line S of fixing belt 81 that is wound around fixing roller 83, a portion into which the air from the first air nozzle 201 can flow in a clearance between the leading edge of sheet p and fixing belt 81 is limited to the vicinity of a point of contact between the tangent line and fixing belt 81. Therefore, it is desirable that the direction for blowing from the first air nozzle 201 is established within a range of angle θ that is made by tangent line S at blowing position K and by extension line E of the nip portion N. Due to this, it is possible to form an air flow along a curved surface of fixing belt 81 covering from blowing position K to nip portion N, thereby, it becomes possible to release even when the leading edge of recording sheet P does not arrive at blowing position K. Incidentally, the extension line E of the nip portion N is a line in the direction in which the recording sheet that has been fixed is conveyed. Further, the first air nozzle 201 and the second air nozzle 301 need to be arranged on an area that is closer to fixing roller 83 than at least the extension line E of the nip portion N is, so that they may not interfere with a sheet ejection path from the nip portion N. And for improving releasing efficiency, it is preferable that a length from the first air nozzle 201 and the second air nozzle 301 to the blowing position K is short as far as possible.

For satisfying the aforesaid conditions, it is desirable that the first air nozzle 201 and the second air nozzle 301 are arranged at the same position as stated above.

In the example of the invention, length L from the outlet of the nip portion N1 to the blowing position K was made to be 10 mm, and a length from K to the first air nozzle 201 and the second air nozzle 301 was made to be 7.5 mm. And angle at which air is blown against blowing position K from the first air nozzle 201 the second air nozzle 301 was established to be 11° relative to extension line E from the nip portion N.

Since air is blown at high air speed from the first air nozzle 201 under the condition that a clearance between the leading edge of recording sheet P and fixing belt 81 is small, after the recording sheet P has passed through the nip portion N, compressed air that is compressed by compressor 205 and is stored in air tank 204 is supplied through electromagnetic valve 203. The electromagnetic valve 203 is usually closed, and it is switched to the opened state, synchronizing with an occasion when the leading edge of recording sheet P is protruded from the nip portion. The timing for switching is determined based on detection of sheet feed sensor 102.

The signal for the opening is sent to electromagnetic valve 203 for the leading edge of recording sheet P to be protruded from the nip portion. Since the electromagnetic valve 203 becomes to be in the state of open in about 20 ms, air blown out of the first air nozzle 201 arrives at its maximum flow rate when the leading edge of recording sheet P is conveyed by about 10 mm from the nip portion N. Since air is supplied under the pressure that is twofold to threefold that of the pressure that is needed for separation, in the present example, a clearance of the leading edge of recording sheet P becomes to be greater before the air blown out of the first air nozzle 201 arrives at its maximum flow rate, namely, before the twining time from the nip portion N arrives at 20 msec. In the experiments for the present example, it has been confirmed that a coated paper for printing that is thin at about 80 g/m$^2$ having thereon solid images of maximum coverage can be released continuously under the air blast of about 20 m/s, if the clearance from fixing belt 81 is broadened to about 0.2 mm, before the leading edge of recording sheet P moves for 20 msec from an outlet portion of the nip portion N.

When separation of recording sheet P advances to a certain extent and when the leading edge of recording sheet P is away from fixing belt 81 by 0.2 mm or more, blowing air having a broader blowing area and having greater air flow amount is more preferable than blowing air having a narrower blowing area and having higher air speed, for giving releasing force to an entire opened area. Therefore, the signal for the closing is sent after 50 ms has elapsed from the moment of sending the signal for the opening to the electromagnetic valve 203, to stop air blowing from the first air nozzle 201. Since the leading edge of recording sheet P is away from fixing belt 81 by 0.2 mm or more, a force to release recording sheet P is applied by air blowing from the second air nozzle 301, even when compressed air is not blown from the first air nozzle 201, and recording sheet P is surely separated from fixing belt 81.

Since separation of recording sheet P is started before the recording sheet P winds itself around for 20 msec as stated above, no image unevenness is caused.

Figure 15:
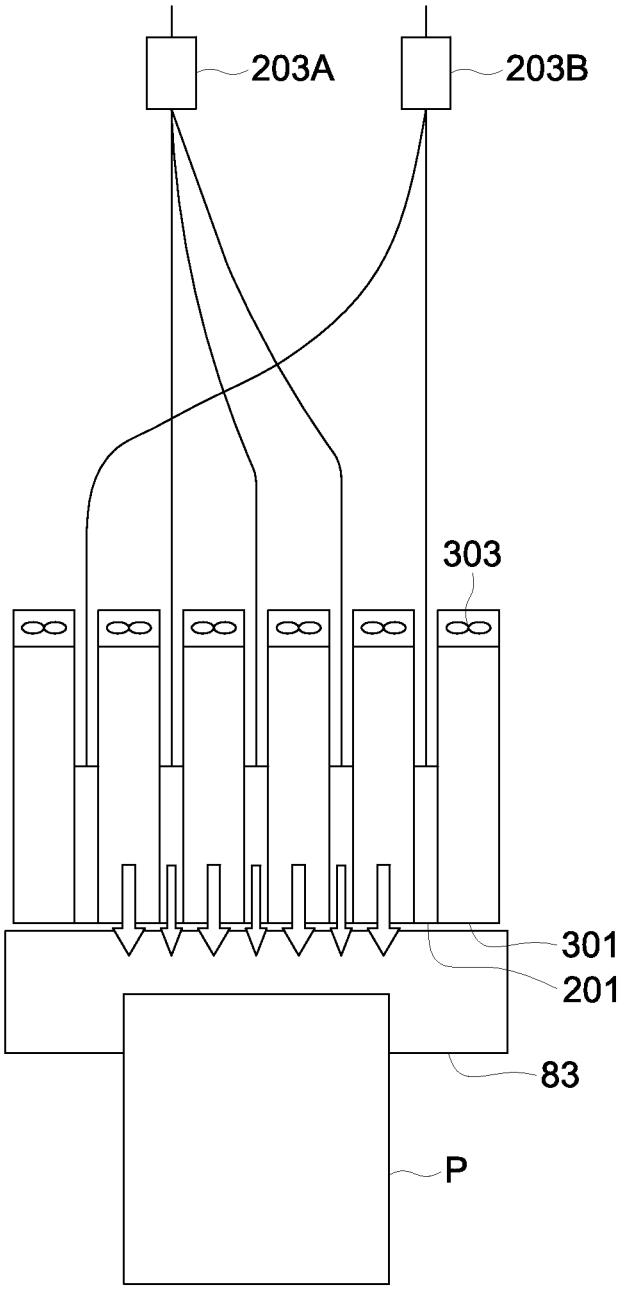
FIG. 15 is a top view relating to the first air nozzle and the second air nozzle having the structure shown in FIG. 6.

FIG. 15 is a top view of the first air nozzle 201 and the second air nozzle 301 corresponding to FIGS. 6 to 8.

In FIG. 15, the first air nozzles 201 in quantity of 5 and the second air nozzles 301 in quantity of 6 are arranged alternately in the direction of an axis of fixing roller 83. And, the first air nozzles 201 in quantity of 3 positioned in the center are connected to electromagnetic valve 203A and, the first air nozzles 201 in quantity of 2 positioned on the outside are connected to electromagnetic valve 203B. On the other hand, the second air nozzles 301 in quantity of 5 are operated by respective 5 fans to send air.

When recording sheet P is in A4 size and it is conveyed on a short-edge-feeding basis (lateral feeding), electromagnetic valve 203A and electromagnetic valve 203B are opened, and air is blown out of the first air nozzles 201 in quantity of 5. Further, 6 fans 303 are rotated, and air is blown out of 6 second air nozzles 301. However, in the case of a long-edge-feeding (longitudinal feeding) and when a width of recording sheet P is small, electromagnetic valve 203A only is opened without opening electromagnetic valve 203B, and air is blown out of only 3 first air nozzles 201 positioned on the center, even if the recording sheet P is in A4 size. Further, two fans 303 positioned at both ends are not rotated, and only 4 fans positioned on the center are rotated, and air is blown out only of 4 second air nozzles 301 positioned on the center. Incidentally, a size of recording sheet P is detected by sheet size detector 104 in FIG. 3, and controller 101 controls electromagnetic valve 203 and switch for fan 304.

Since electromagnetic valve 203 and switch for fan 304 are operated depending on a size of recording sheet P, useless power consumption is eliminated, and heat dissipation and heat contamination caused by fixing belt 81 can be controlled.

Incidentally, in the aforesaid constitution, the number of the first air nozzles 201 and that of the second air nozzles 301 are not limited.

With respect to the fixing device using the aforesaid first air nozzle 201 and the second air nozzle 301, it is not limited to the aforesaid fixing device, and it may be any type of fixing device. For example, it may be a fixing device of a heat roller fixing type wherein a recording material onto which a toner image has been transferred is heated and pressed while it is interposed and conveyed on a nip portion that is formed by a fixing roller (fixing member) having therein a built-in heating device such as a halogen heater and a pressure-applying roller (pressing member) that applies pressure or the fixing roller.

Incidentally, in front and in the rear of the image forming apparatus shown in FIG. 1, there are provided louvers, and the open air sucked in through openings of the louvers is guided to the fan positioned at the outlet side of the fixing device through an air-guide duct arranged on the upper portion of the fixing device. This air-guide duct is kept to be at a low temperature by the open air, and it controls temperature rise on a toner storing section caused by thermal diffusion from the fixing device.

Air blown out of the first air nozzle 201 and of the second air nozzle 301 is guided to opening provided on the end portion of the image forming apparatus on the fixing device side, by the duct whose wall is a part of recording sheet conveyance guide, to be ejected. Further, if an air ejecting fan is provided on the opening, air can be ejected efficiently, thus, heat contamination in the device caused by air that is blown against the fixing device to be raised in terms of temperature can be controlled to the minimum level. Meanwhile, when connecting a post-processing device to an image reading device, openings are provided on the top surface and on the rear surface of the image forming apparatus to eject air.

In the embodiments for a fixing device and an image forming apparatus of the invention, there are exhibited effects that high power compressor is not needed and an apparatus is not large, in spite of the structure to release a recording material from a fixing device by compressed air. In addition, it is possible to blow air efficiently against a fixing member and to release a recording material surely from a fixing member, because a first blowing device to eject out compressed air to the vicinity of the nip portion and a second blowing device to eject out air sent by a fan are arranged functionally.

What is claimed is:

1. A fixing device that fixes a toner image on a recording material in a nip portion formed by a heated fixing member and a pressing member that is kept in pressure contact with the fixing member, the fixing device comprises:

(a) a first blowing section that blows air against a neighborhood of a leading edge of the recording material that has passed through the nip portion; and (b) a second blowing section that blows air against the recording material that has passed through the nip portion, wherein an air speed of air that is blown out of a first blowing outlet provided on the first blowing section is higher than an air speed of air blown out of a second blowing outlet provided on the second blowing section, wherein an air flow amount of the air blown out of the first blowing outlet is less than that of the air blown out of the second blowing outlet, wherein the first blowing section blows air compressed by a compressor and the second blowing section blows air sent by a fan, and wherein the first blowing outlet and the second blowing outlet are arranged at a same positional height next to one another along a rotational axis of the fixing member.

2. The fixing device of claim 1, wherein the first blowing outlet and the second blowing outlet are arranged alternatingly in the direction that is in parallel with the rotational axis of the fixing member.

3. The fixing device of claim 2, wherein a first air guide section having the first blowing outlet and a second air guide section having the second blowing outlet, are arranged alternatingly in the direction that is in parallel with the rotational axis of the fixing member.

4. The fixing device of claim 3, wherein a plurality of the first blowing outlets are arranged continuously in a row or a plurality of rows on the first air guide section.

5. The fixing device of claim 2, wherein a density on an end portion close to the second air guide section, of the first blowing outlets on the first air guide section, is higher than that on a central portion thereof, and a width on an end portion close to the first air guide section in a direction perpendicular to the rotational axis of the fixing member, of the second blowing outlets, is wider than that on a central portion thereof.

6. The fixing device of claim 2, wherein a circumferential wall that forms the first blowing outlet is formed integrally with a circumferential wall that forms the second blowing outlet, and a plurality of the first blowing outlets are arranged in the direction in parallel with the rotational axis of the fixing member.

7. The fixing device of claim 6, wherein a part of the circumferential wall that forms the first blowing outlet, is protruded into an inside of the second blowing outlet.

8. The fixing device of claim 6, wherein a plurality of connecting sections each of which is formed by connecting opposing circumferential walls that form the second blowing outlet, in the direction perpendicular to the rotational axis of the fixing member, are formed intermittently in the direction in parallel with the rotational axis, and the first blowing outlets are provided on the each of the connecting sections.

9. The fixing device of claim 8, wherein a blowing position to the fixing member to which air from the first blowing section is blown out, is set to a position at which the leading edge of the recording material is moved along a circumferential surface of the fixing member from a nip outlet of the nip portion within 20 ms.

10. The fixing device of claim 9, wherein the air from the first blowing section is blown out toward the blowing position within a range of an angle that is made by a tangent line to the fixing member at the blowing position and by an extension line of the nip portion.

11. The fixing device of claim 1, further comprising a rotatable roller having a supporting shaft in the direction in parallel with the rotational axis of fixing member, which regulates a gap between the circumferential wall that forms the second blowing outlet and the fixing member.

12. The fixing device of claim 1, wherein a distance between the first blowing outlet and the nip portion is shorter than a distance between the second blowing outlet and the nip portion.

13. An image forming apparatus comprising the fixing device of claim 1.

14. A fixing device that fixes a toner image on a recording material in a nip portion formed by a heated fixing member and a pressing member that is kept in pressure contact with the fixing member, the fixing device comprising:

(a) a first blowing section that blows air against a neighborhood of a leading edge of the recording material that has passed through the nip portion; and (b) a second blowing section that blows air against the recording material that has passed through the nip portion, wherein an air speed of air that is blown out of a first blowing outlet provided on the first blowing section is higher than an air speed of air blown out of a second blowing outlet provided on the second blowing section, wherein an air flow amount of the air blown out of the first blowing outlet is less than that of the air blown out of the second blowing outlet, wherein the first blowing section blows air compressed by a compressor and the second blowing section blows air sent by a fan, and wherein the first blowing outlet and the second blowing outlet are arranged at the exact same position in a direction that is in parallel with a rotational axis of the fixing member.

15. The fixing device of claim 14, wherein the first blowing outlet and the second blowing outlet are stacked one atop another at the position in a direction that is in parallel with the rotational axis of the fixing member.

16. The fixing device of claim 14, wherein the first blowing outlet and the second blowing outlet are commingled at one position in a direction that is in parallel with the rotational axis of the fixing member.

* * * * *